US009492339B2

(12) United States Patent
Leib

(10) Patent No.: US 9,492,339 B2
(45) Date of Patent: Nov. 15, 2016

(54) CHAIR, FRAME AND LIFTING GARMENT USEFUL FOR PATIENTS

(75) Inventor: Roger Kenneth Leib, Los Angeles, CA (US)

(73) Assignee: Develop, LLC, Los Angeles, CA (US)

( * ) Notice: Subject to any disclaimer, the term of this patent is extended or adjusted under 35 U.S.C. 154(b) by 109 days.

(21) Appl. No.: 14/131,422

(22) PCT Filed: Jul. 6, 2012

(86) PCT No.: PCT/US2012/045863

§ 371 (c)(1),
(2), (4) Date: Jan. 7, 2014

(87) PCT Pub. No.: WO2013/006845

PCT Pub. Date: Jan. 10, 2013

(65) Prior Publication Data

US 2014/0138995 A1 May 22, 2014

Related U.S. Application Data

(60) Provisional application No. 61/612,781, filed on Mar. 19, 2012, provisional application No. 61/505,264, filed on Jul. 7, 2011.

(51) Int. Cl.

| | |
|---|---|
| ***A61G 5/14*** | (2006.01) |
| ***A61G 7/10*** | (2006.01) |
| ***A61H 3/00*** | (2006.01) |

(52) U.S. Cl.

CPC . *A61G 5/14* (2013.01); *A61G 7/10* (2013.01); *A61G 7/1046* (2013.01); *A61G 7/1051* (2013.01); *A61H 3/008* (2013.01)

(58) Field of Classification Search

CPC ..... A61G 7/1044; A61G 7/1046; A61G 5/14; A61G 1/003; A61G 7/10; A61G (Continued)

(56) References Cited

U.S. PATENT DOCUMENTS 2,563,629 A * 8/1951 Watter ..... 297/423.36
3,638,647 A * 2/1972 Creelman ..... 5/89.1

(Continued)

FOREIGN PATENT DOCUMENTS

DE 102007050575 A1 * 4/2009
WO 9214432 A1 3/1992
WO 2010105773 A1 9/2010

OTHER PUBLICATIONS

Web page printout of product sheet, http://www.arjohuntleigh.com/usah/Products.asp?pagenumber=2940&ProductCategory_Id . . . Jun. 19, 2012.

(Continued)

*Primary Examiner* — Milton Nelson, Jr.
(74) *Attorney, Agent, or Firm* — Jeffrey G. Sheldon; Leech Tishman Fuscaldo & Lampl

(57) ABSTRACT

A system for supporting, lifting, moving, mobilizing, ambulating, and physically rehabilitating a user such as patients in hospitals comprises a chair 100, a frame 200, and a lifting garment 300. The chair 100 has a seat 102 having a front portion 104 and a rear portion 106 and is so constructed that as the seat 102 moves towards a standing position, the rear portion 106 of the seat 102 remains substantially horizontally so a user does not slide out of the seat. The frame 200 is constructed so that the user can enter the frame 200 from either the front side 202 or the rear side 204. The lifting garment 300 is made of a fabric that contracts normal to a direction in which it is pulled for ease in raising a patient in or out of a bed, a chair, or a toilet, to or from a standing position.

16 Claims, 18 Drawing Sheets

(58) Field of Classification Search

CPC ..... 7/1051;A61H 3/008; A47D 13/046; A47C 1/032

USPC ..... 5/83.1, 86.1, 89.1, 85.1, 81.1 R, 87.1, 5/84.1; 297/274, 275, 273, DIG. 10, 316, 297/330, 423.27, 423.26, DIG. 4, 411.39; 248/163.2, 440.1, 610, 317; 482/38, 482/43, 69, 66, 51; 601/23, 35; 104/89; 472/32

See application file for complete search history.

(56) References Cited

U.S. PATENT DOCUMENTS

| | | | | |
|---|---|---|---|---|
| 3,807,795 | A | 4/1974 | Weant et al. | |
| 4,249,774 | A | 2/1981 | Andreasson | |
| 4,252,063 | A * | 2/1981 | Brooks, Jr. | 104/89 |
| 4,862,529 | A | 9/1989 | Peck | |
| 4,905,989 | A * | 3/1990 | Colvin et al. | 482/69 |
| 5,187,822 | A | 2/1993 | Merry | |
| 5,201,693 | A * | 4/1993 | Sparkes | 482/69 |
| 5,603,677 | A * | 2/1997 | Sollo | 482/69 |
| 5,784,729 | A | 7/1998 | Dunn et al. | |
| 5,802,633 | A | 9/1998 | Capaldi | |
| 5,845,348 | A | 12/1998 | Dunn et al. | |
| 5,984,411 | A | 11/1999 | Galumbeck | |
| 6,142,568 | A * | 11/2000 | Abelbeck et al. | 297/344.17 |
| 6,425,154 | B1 | 7/2002 | O'Connell | |
| 6,539,569 | B2 | 4/2003 | O'Connell | |
| 6,540,250 | B1 * | 4/2003 | Peterson | 280/657 |
| D510,204 | S | 10/2005 | Leib | |
| 7,020,913 | B2 | 4/2006 | Van Scheppingen et al. | |
| D524,568 | S | 7/2006 | Leib | |
| D525,450 | S | 7/2006 | Leib | |
| D526,802 | S | 8/2006 | Leib | |
| RE39,254 | E | 9/2006 | Von Schroeter et al. | |
| 7,195,583 | B2 | 3/2007 | Leib | |
| D543,719 | S | 6/2007 | Leib | |
| 7,356,858 | B2 | 4/2008 | Summers | |
| 7,540,565 | B2 | 6/2009 | Lipford | |
| 7,725,964 | B2 | 6/2010 | Minning et al. | |
| 7,827,630 | B2 | 11/2010 | Bostelman et al. | |
| 7,865,983 | B2 | 1/2011 | Newkirk et al. | |
| 7,992,237 | B2 | 8/2011 | Minning et al. | |
| 8,056,162 | B2 | 11/2011 | Newkirk et al. | |
| 8,480,602 | B1 * | 7/2013 | Cook | 601/35 |
| 8,636,623 | B2 * | 1/2014 | Ross et al. | 482/15 |
| 2001/0029627 | A1 | 10/2001 | Von Schroeter | |
| 2004/0002407 | A1 | 1/2004 | Hawkes | |
| 2004/0045073 | A1 | 3/2004 | Marquez | |
| 2006/0267389 | A1 | 11/2006 | De Kroon et al. | |
| 2007/0054784 | A1 * | 3/2007 | Wu et al. | 482/69 |
| 2007/0057554 | A1 | 3/2007 | Lipford | |
| 2010/0148542 | A1 * | 6/2010 | Zidulka | 297/174 R |
| 2010/0199422 | A1 | 8/2010 | Patwardhan | |
| 2010/0207354 | A1 | 8/2010 | Hunziker | |
| 2010/0212087 | A1 | 8/2010 | Leib et al. | |
| 2011/0302711 | A1 | 12/2011 | Biersteker | |
| 2012/0004581 | A1 | 1/2012 | Dinon | |
| 2012/0005825 | A1 | 1/2012 | Minning et al. | |

OTHER PUBLICATIONS

PCT/US2012/045863 International Search Report dated Apr. 8, 2013.

EP12806877.2 European Search Report dated Feb. 26, 2015, 7 pages.

* cited by examiner

CHAIR, FRAME AND LIFTING GARMENT USEFUL FOR PATIENTS

CROSS-REFERENCE TO RELATED APPLICATIONS

The present Application is a national stage of International Patent Application No. PCT/US2012/045863, titled "Chair, Frame and Lifting Garment Useful for Patients," filed Jul. 6, 2012, which also claims the benefit of U.S. Provisional Patent Application No. 61/505,264 filed Jul. 7, 2011, and U.S. Provisional Patent Application No. 61/612,781 filed Mar. 19, 2012, the contents of which are incorporated in this disclosure by reference in their entirety.

BACKGROUND

It is widely acknowledged that patients are moved and mobilized in order to optimize their recovery from illness, yet a sedentary model of care dominates our acute care system. Care is bed-based, and most patients are permitted or even encouraged to remain in bed well beyond the time where various forms of deterioration—known as "immobility-related adverse events"—begin to set in.

The need for supporting, lifting, moving, mobilizing, ambulating, and rehabilitating patients can cause musculo-skeletal injury to caregivers. This is because patient support platforms such as beds, chairs, and toilets typically provide no assistance in a patient getting into/onto or out of/off them. To protect workers and lower workmen's compensation costs associated with caregiver musculo-skeletal injury, many institutions have a "no-lift" policy and obtain equipment to assisting the lifting and mobilization of patients. However, compliance of caregivers with the policy can be low due to the inconvenience of using available equipment, essentially all of which has been developed with a materials-handling mentality of moving an object from one location to another but without the goal of sustaining a patient upright or mobilizing patients on a continuing basis. And because they are single-purpose items, they are stored elsewhere and have to be retrieved for use rather than remaining in-room and on-hand as a room furnishing by virtue of their continuing multi-functionality. In addition, both chairs and beds do not assist debilitated patients in remaining upright and out of bed, so patients are driven back to sedentary in-bed postures. So while the physical rehabilitation process should begin and continue in the patient room, it usually does not, for lack of appropriately designed and conceived on-hand equipment.

Inability to easily mobilize a patient or to support a patient in an upright posture is also present in the home environment. To minimize the cost of care and lessen exposure to infection, patient stays in hospitals and nursing homes are being shortened, resulting in an increasing portion of a patient's recovery taking place in a home environment under the care of care partners (i.e. family, friends, or hired help). However, suitable equipment for mobilizing a patient in the home is also lacking.

For the foregoing reasons, there is a need for a better system to support, move, and mobilize patients.

SUMMARY

The present invention provides a system that satisfies this need, the system comprising a chair, a frame, and a lifting garment. The chair comprises a seat having a front portion and a rear portion with a pivot mechanism between the front and rear portions so the front portion can pivot relative to the rear portion. The seat has a sitting position with the seat being substantially horizontal. The back extends upwardly from the rear portion of the seat. The seat is supported by legs. The seat can pivot upwardly from a pivot location at the front portion of the seat for lifting a user toward the standing position, wherein the front portion pivots relative to the rear portion so that the rear portion of the seat remains substantially horizontal as the seat pivots upwardly towards the standing position. A drive, such as a linear drive, pivots the seat upwardly toward the standing position. The rear portion remains substantially horizontal as the seat pivots towards the standing position to prevent a user from sliding out of the chair. This can be accomplished with a rear support beneath the rear portion of the seat and a front support beneath the front portion of the seat pivotally connected to the rear support. The support system can be one or more collapsible frames such as collapsible parallelograms. The drive can pull downwardly on the collapsible frame, or push upwardly on the collapsible frame, or on the front portion of the seat. The amount the collapsible frame can open can be limited with a stop mechanism.

Typically the front portion of the seat is about twice as long as the rear portion. Preferably the back has a lordotic curvature in its upright position, and when the back reclines the lordotic curvature automatically partially flattens.

Preferably there is a leg rest that comprises a leg section pivotally attached to the front of the seat to pivot from a retracted position to an extended position, with a foot support section mounted to the leg section. There can be friction reducers, such as wheels, for reducing the friction between the foot support and a support surface, such as a floor, on which the chair is supported.

Preferably the drive includes not only a linear drive but also a fly wheel motor, which in combination with the linear drive facilitates both lifting and rocking of a user.

The second part of the system includes a support frame that can be used with the chair or separately. The frame has a front side and a rear side and comprises a pair of spaced apart supports, such as sleds. The supports are spaced apart a sufficient distance that a user can fit therebetween from both the front side and the rear side. A pair of parallel legs extends upwardly front the forward portion of the frame. Each leg has a top and a connector fixedly connects the top of the legs. There is no other permanent connector between the legs, including at the base, so that the user can have access from both the front and rear sides of the frame. Preferably the connector is at least six feet above the ground surface so a user can stand beneath the frame. Preferably the connector is cantilevered from the legs.

Preferably at least one of the legs comprises a longitudinally extending support of constant outer diameter for at least portion of its length so devices supported by the leg can be moved upwardly and downwardly. Also preferably at least one of the legs comprises a contained hollow section for at least a portion of its length for electrical wiring and the like. For example each leg can comprise at least four longitudinally extending tubular supports connected to each other by rods in a square pattern in horizontal cross section with a hollow space therebetween.

The support frame can slidably support a tray between the legs so the tray can be raised and lowered, and the tray is preferably substantially transparent. The frame can be used with a chair, with the chair placed proximate to or beneath the frame, or in conjunction with a bed or toilet. The frame can have a rechargeable battery and the chair or bed can comprise a power source for charging the battery.

The frame can include a lift motor for raising a user such as out of a chair or out of a bed.

The third part of the system is a lifting garment having a torso section made of fabric that contracts normal to the direction in which it is pulled, and attachment means, such as rings, for attaching a lifting device to the garment. A fabric that provides contraction feature can be a woven or knit material having a bias and oriented so that lifting the person wearing the garment in a lifting direction causes tightening of the garment on the person in a direction angled relative to the lifting direction.

DRAWINGS

These and other features, aspects, and advantages of the present invention will become better understood with regard to the following description, appended claims, and accompanying drawings where:

Figure 1:
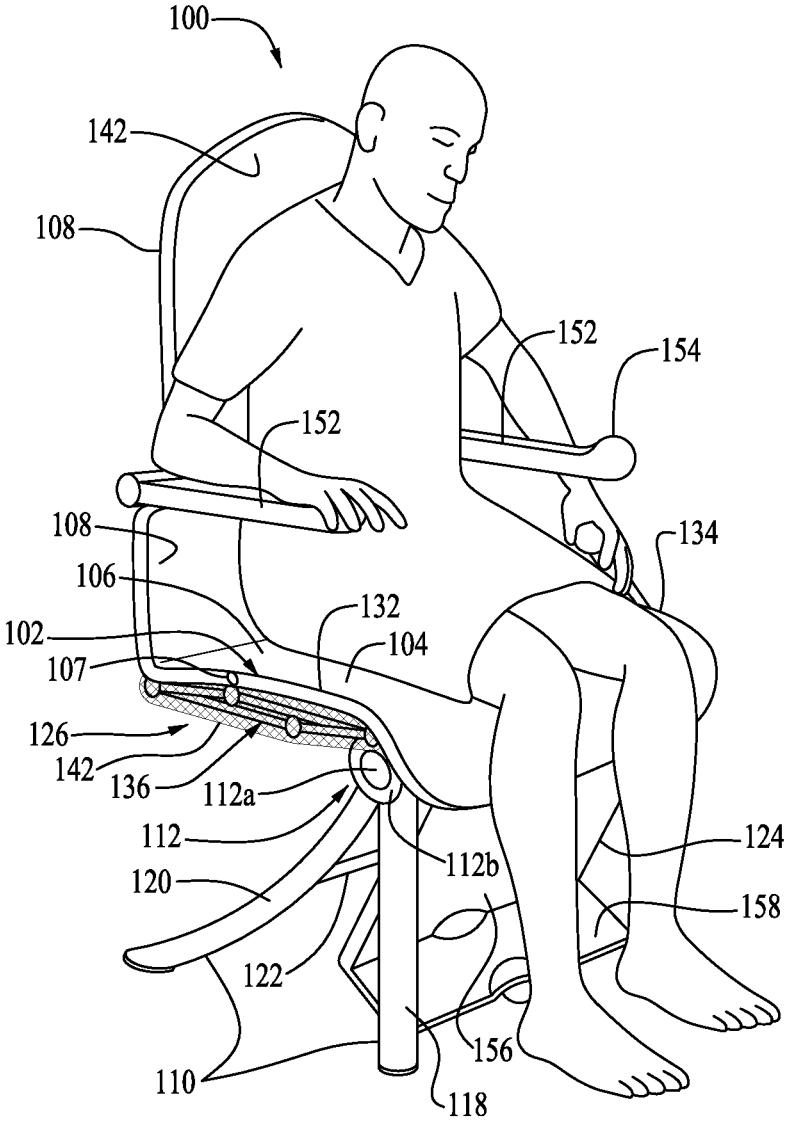
FIG. 1 is a perspective view of a version of a chair according to the present invention in a sitting position.
Figure 8:
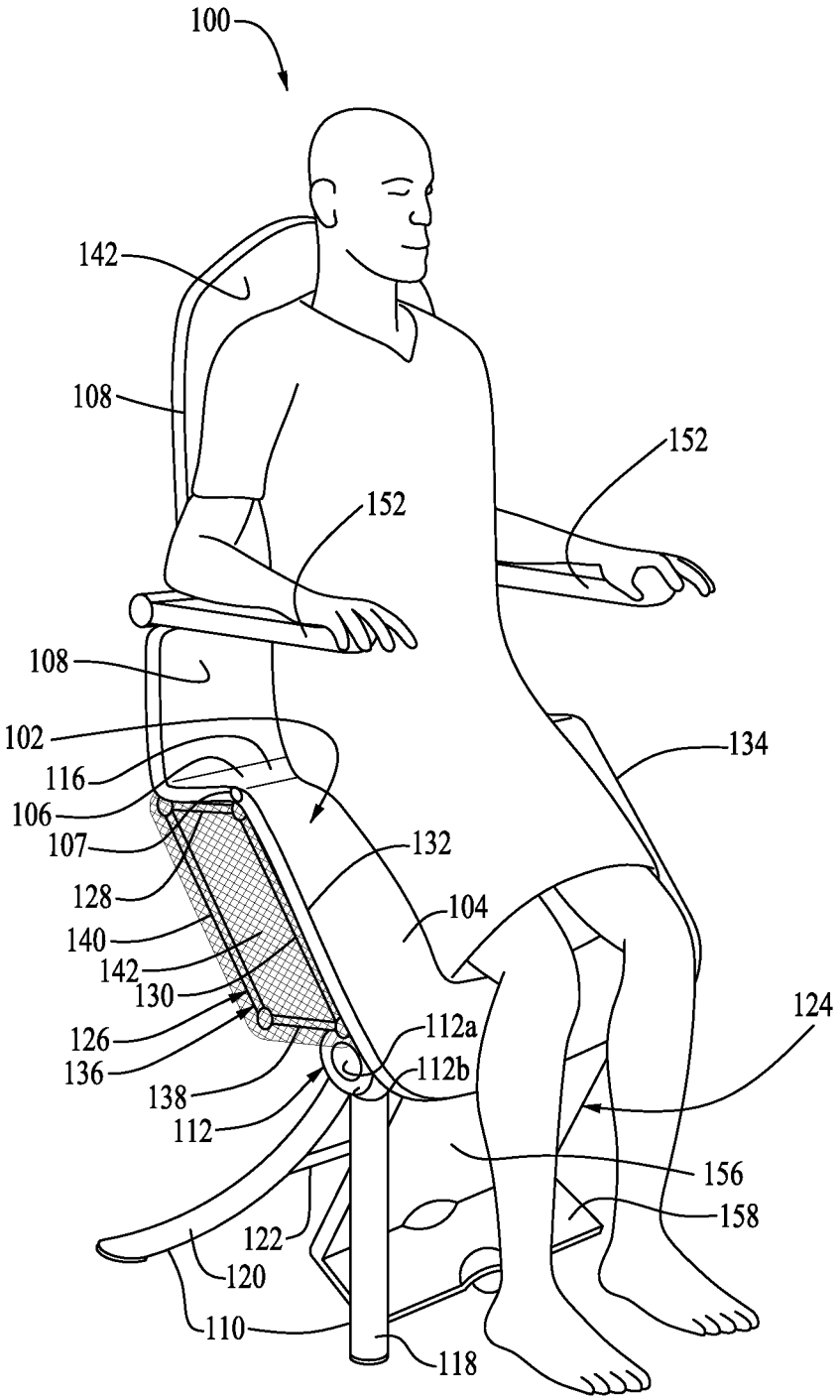
Figure 9:
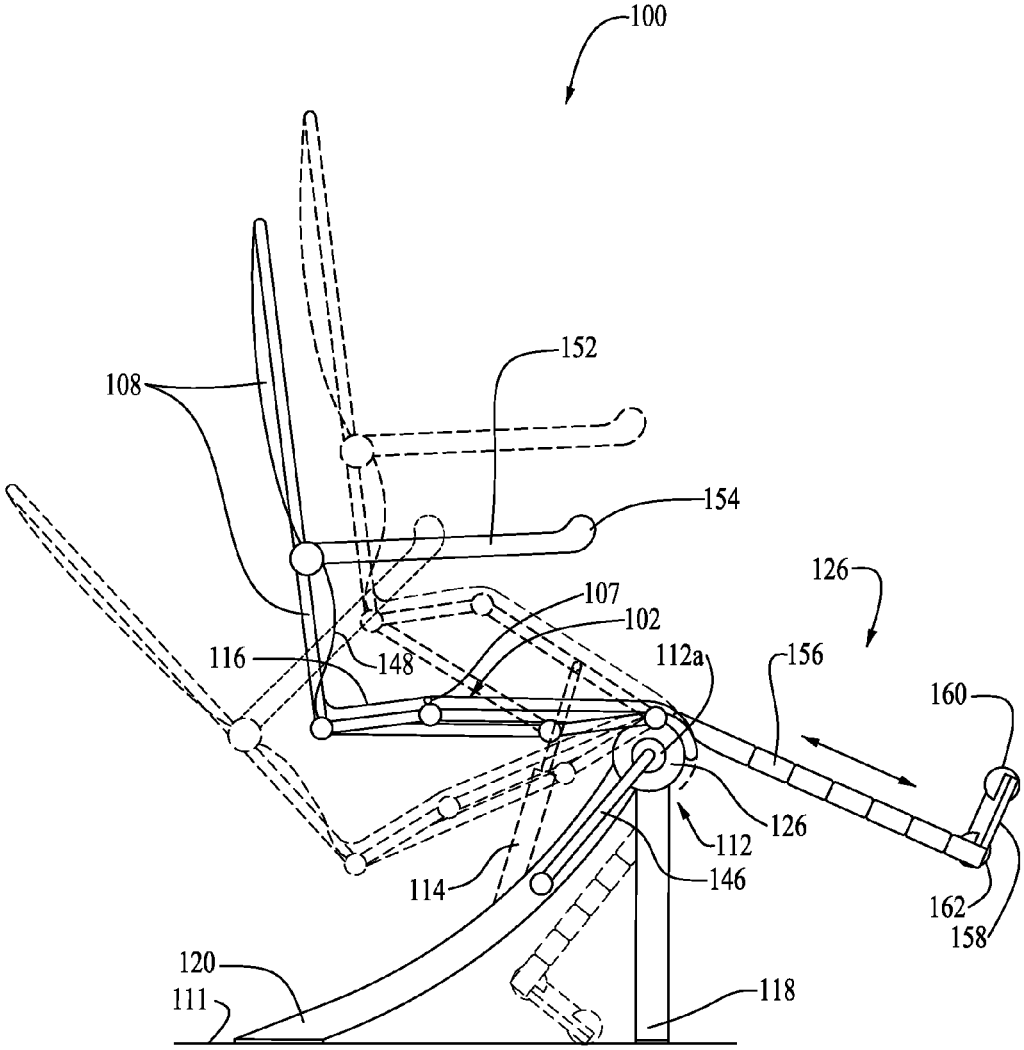
Figure 10:
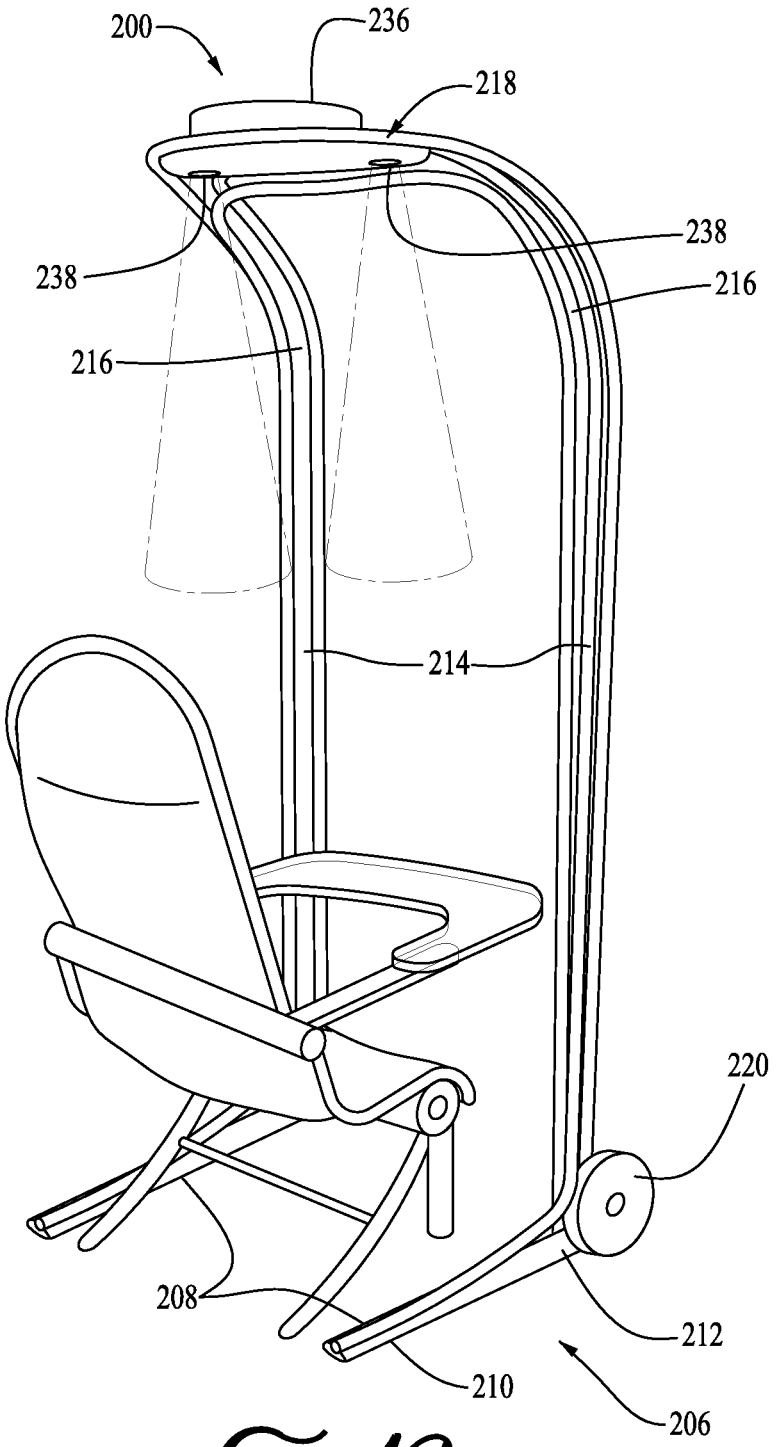
Figure 11:
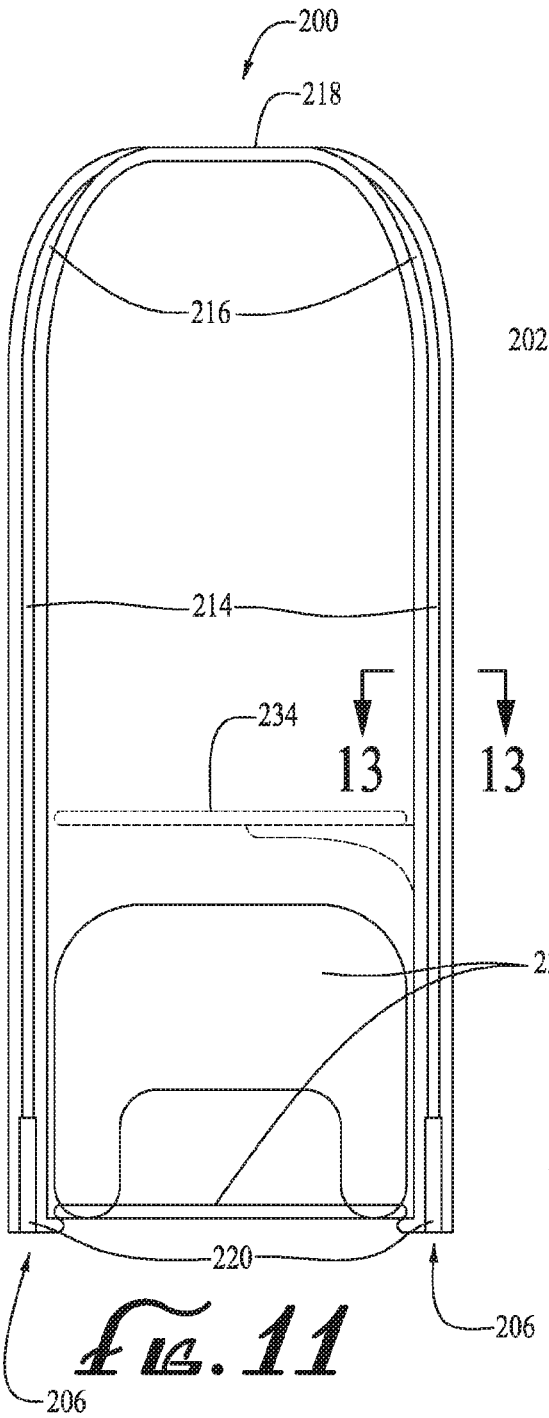
Figure 12:
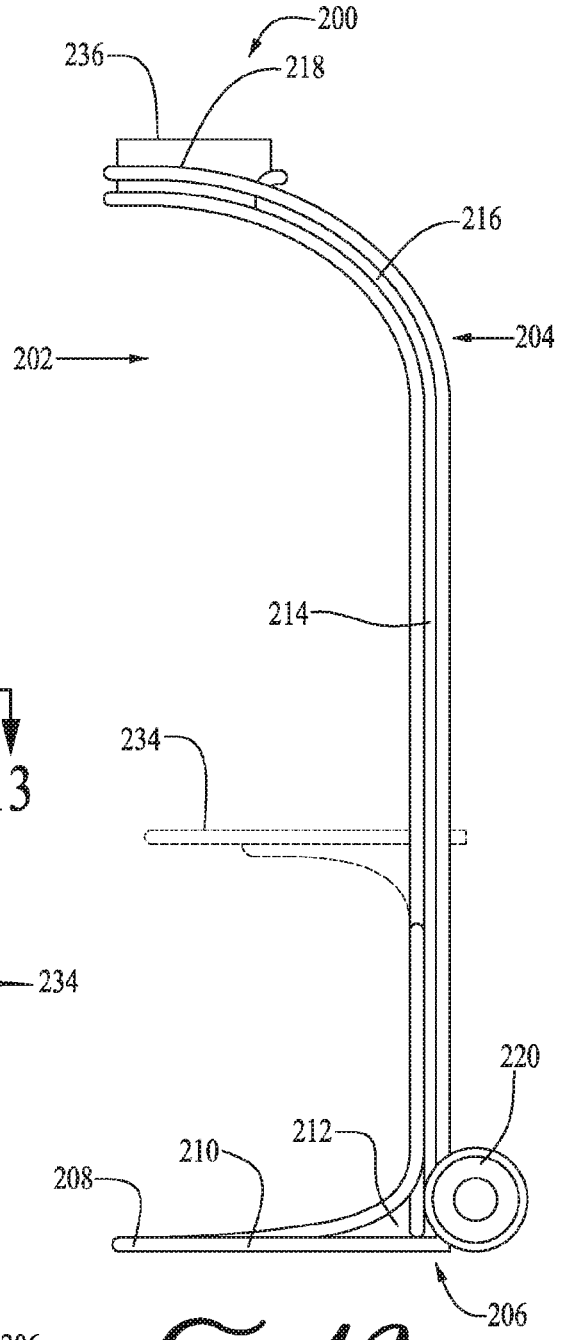
Figure 13:
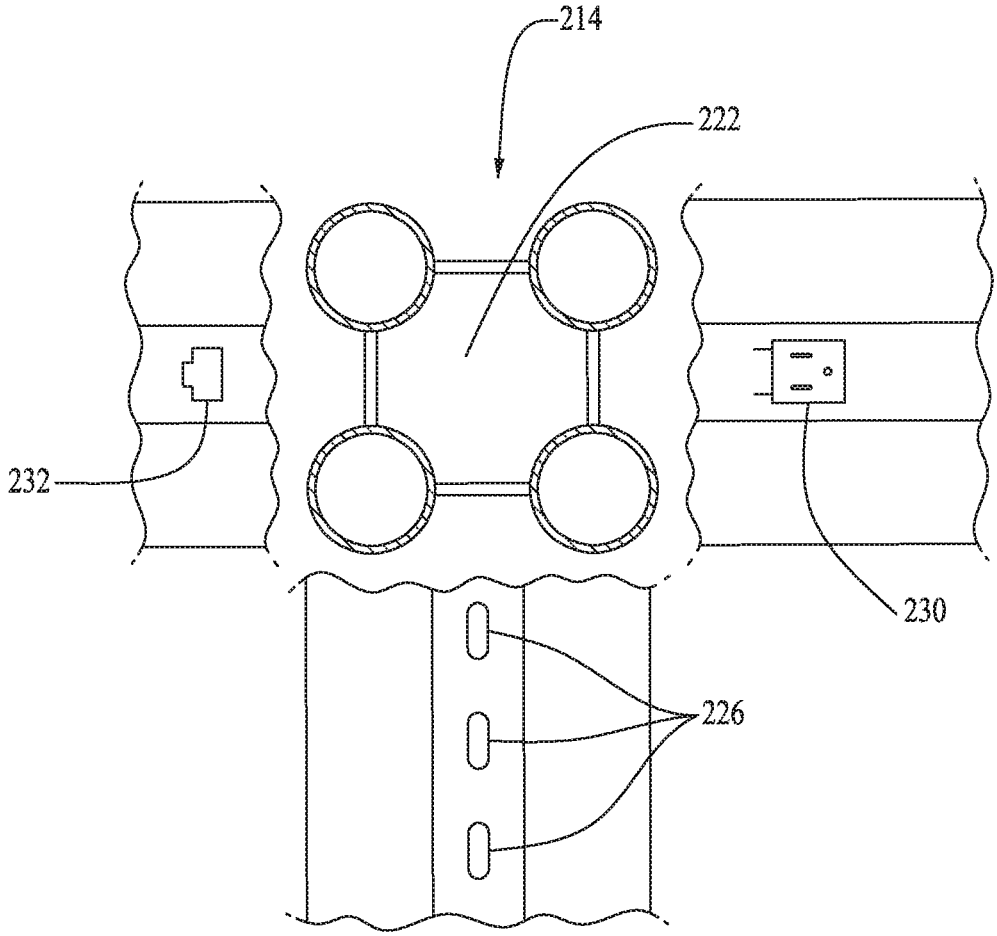
Figure 14:
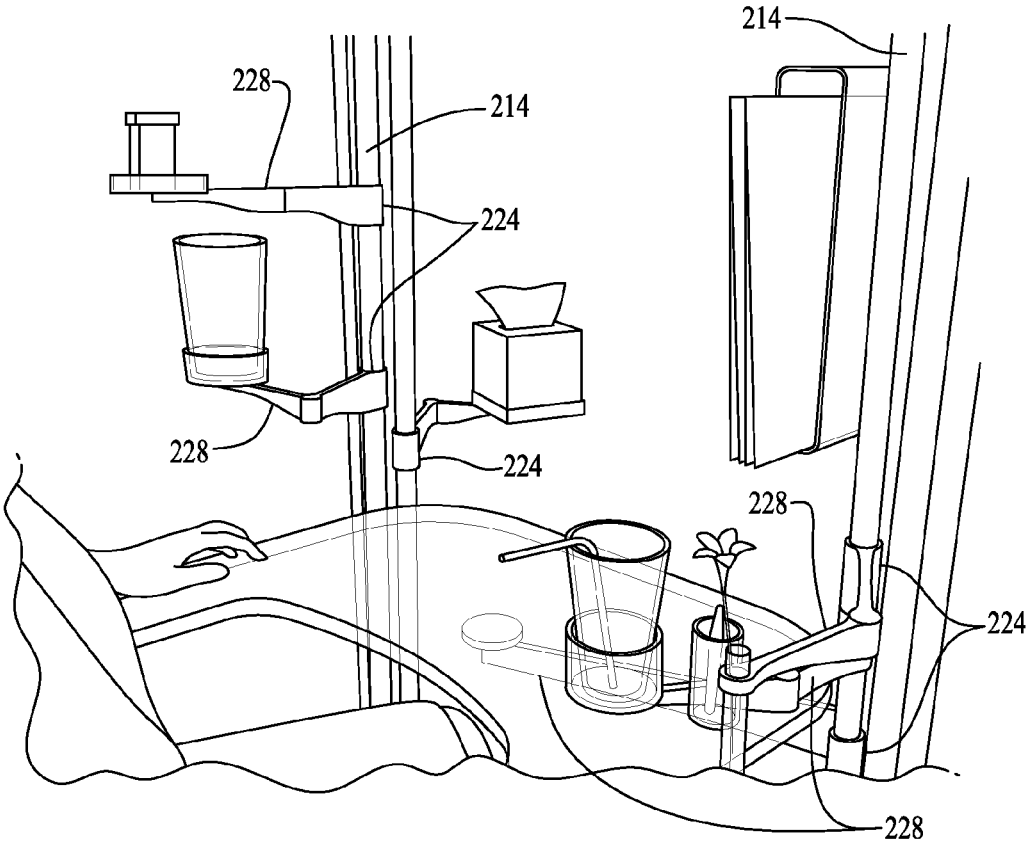
Figure 15:
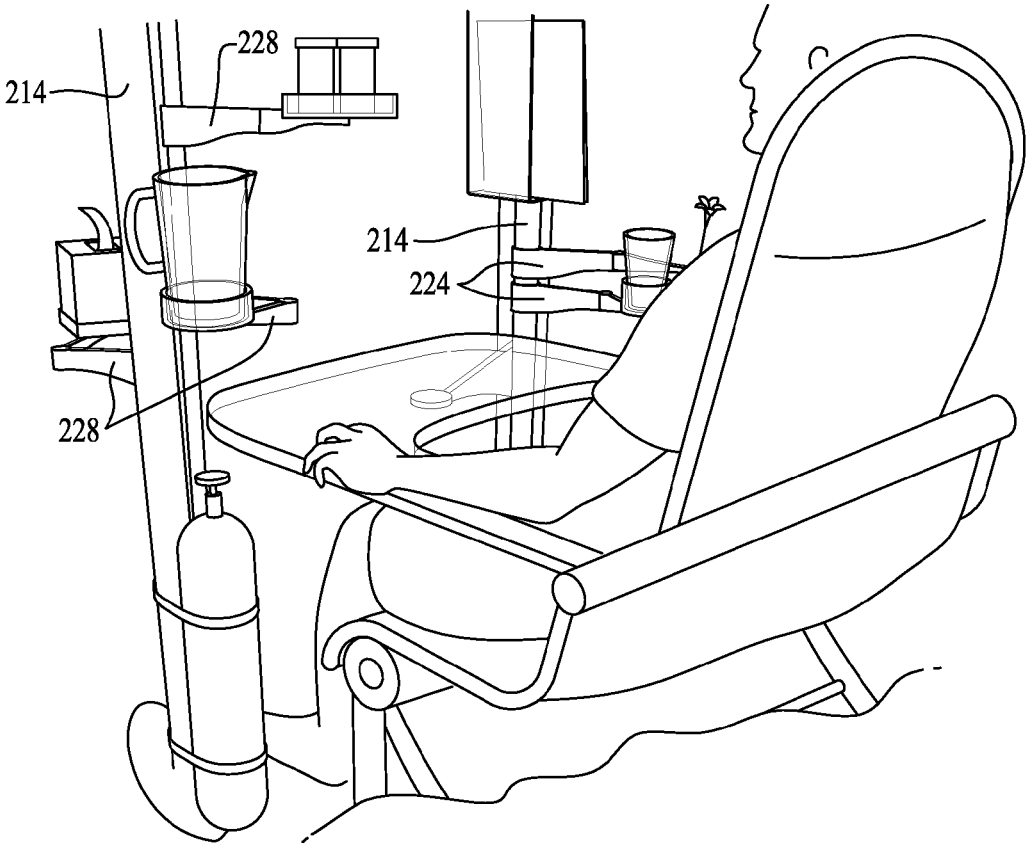
Figure 16:
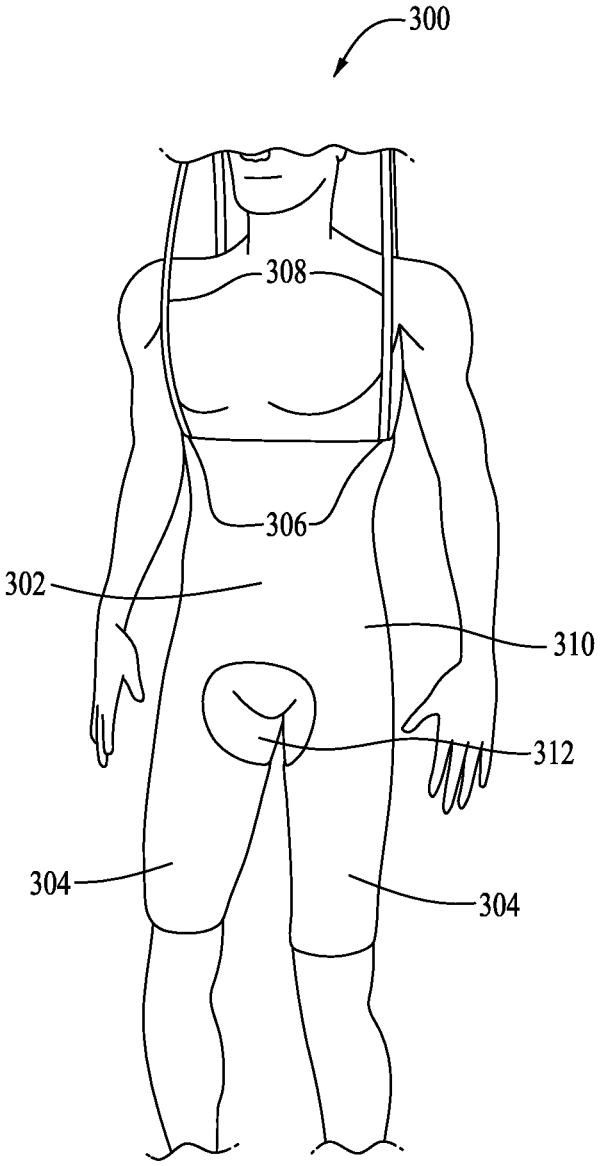

Each of FIGS. 3A-3F is a side elevation view of the chair of FIG. 1 showing the various ways of connecting a linear drive and gear motor to the chair, along with the features of a flex/hinge point and spring for reclining;

Each of FIGS. 4-7 is a side elevation view of the chair of FIG. 1 in a reclined position, in the sitting position with a leg rest elevated, in the sitting position with the leg rest lowered so that a rear wheel engages a floor, and in the sitting position with the leg rest shortened and retracted, respectively;

FIG. 8 is a perspective view of the chair of FIG. 1 in the standing position;

FIG. 9 is a side schematic view of the chair of FIG. 1 showing the various positions of the chair;

FIG. 10 is a perspective view of a support frame according to the present invention in combination with a chair;

FIG. 11 is a rear elevation view of the support frame of FIG. 10 with a tray in a flip up position;

FIG. 12 is a side elevation view of the support frame of FIG. 10;

FIG. 13 is a sectional view of a version of a leg of support of FIG. 10, taken along line 13-13 of FIG. 11;

FIGS. 14 and 15 are perspective views of the support frame of FIG. 10 with multiple attachments; and FIG. 16 is a perspective view of a version of a lifting garment according to the present invention.

DESCRIPTION

In the following description, certain terminology is used to describe certain features of one or more embodiments of the invention.

"Lordotic" means the normal curvature of a person's spine.

Chair

With regards to FIGS. 1-9, a chair 100 for lifting, moving, and mobilizing individuals, such as patients in a hospital, in a nursing home, or at home, having features of this invention is shown. The chair 100 comprises a seat 102 having a front portion 104 and a rear portion 106, the chair 100 having a sitting position with the seat 102 being substantially horizontal, a pivot mechanism 107 between the front portion 104 and rear portion 106 so they can pivot relative to each other, a back 108 extending upwardly from the rear portion 106 of the seat 102, and a support 110 for supporting the seat 102 above a support surface 111. The seat 102 pivots upwardly from a pivot location 112 at the front portion 104 of the seat 102 for lifting a user toward a standing position as shown in FIG. 8, wherein the rear portion 106 pivots relative to the front portion 104 so that the rear portion 106 of the seat 102 remains substantially horizontal as the seat 102 pivots upwardly toward the standing position. To move the chair toward the standing position, a drive 114 can engage the front portion 104 of the seat 102 or the pivot location 112 for pivoting the seat upwardly. Engagement can be directly by the drive 114 or against an intermediate structure such as the collapsible frame described below. Engagement can be pushing or pulling. The rear portion 106 of the seat 102 can comprise a pelvic support portion 116. Preferably, the rear portion 106 comprises about one-third the area of the seat 102.

The support 110 can comprise sleds, but preferably comprises front legs 118 and rear legs 120, the rear legs 120 being attached to the front portion 104 of the seat 102. A drive support 122 for the drive 114 can be a bar that extends between the rear legs 120 for support. The drive 114 is adapted to push and pull on the front portion 104 of the seat 102 by extending and retracting. The drive 114 can be a linear drive 115 such as a screw drive.

Figure 3:
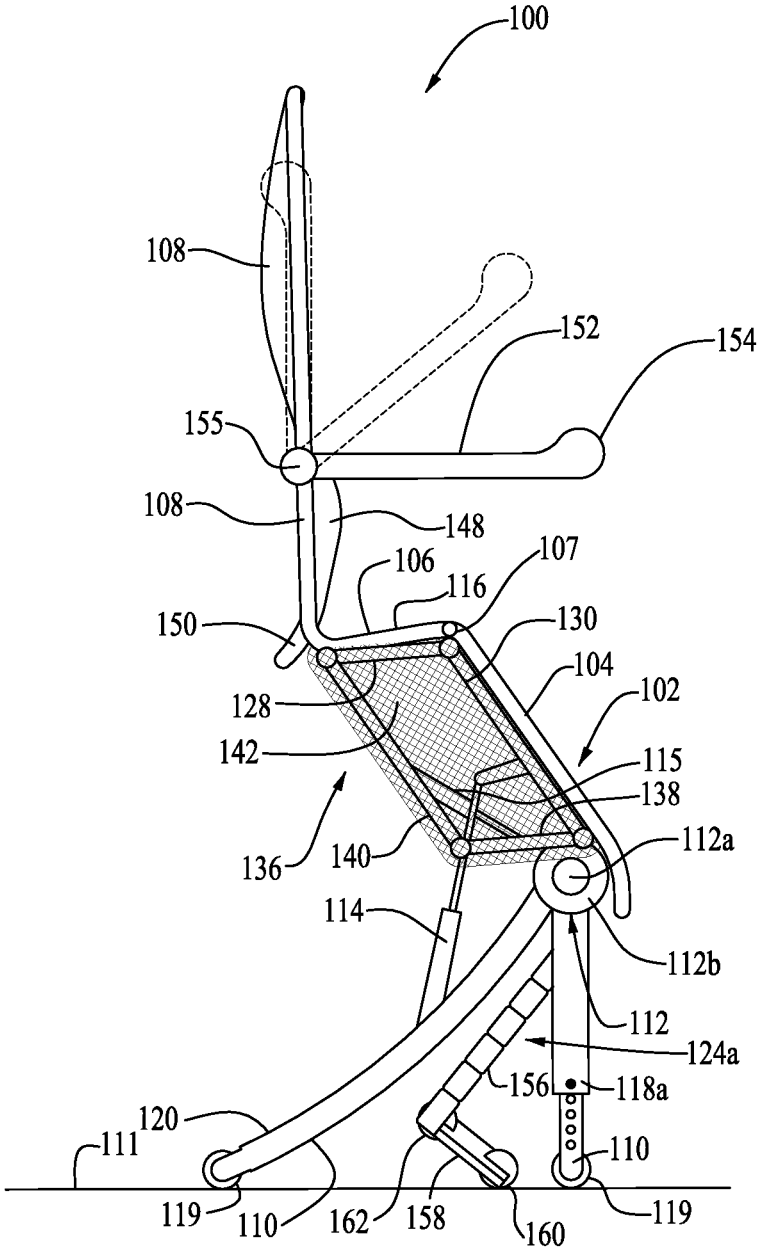
FIG. 3 is a side elevation view of the chair of FIG. 1 in a standing position.

As shown in FIG. 3, the front legs 118 and rear legs 120 each have an upper end and a lower end, with both pairs of legs connected at their upper ends to the front portion 104 of the seat 102. The front legs 118 can be adapted to telescope 118*a*, and the lower end of each leg can have a wheel 119.

A leg rest 124 can optionally be provided. The leg rest 124 can be affixed to and rotate around the pivot location 112, which can comprise a rotating hub 112*a* supported by a rod 112*b*, for lifting the leg rest 124 to remain substantially co-planar with the seat 102.

In one version, the seat 102 has a support system 126 comprising a rear support 128 beneath the rear portion 106 of the seat 102 for maintaining the rear portion 106 of the seat 102 substantially horizontal as the seat 102 pivots upwardly toward the standing position, and a front support 130 beneath the front portion 104 of the seat 102 pivotally connected to the rear support 128 for supporting the front portion 104 of the seat 102. The seat 102 has opposed side edges 132 and 134. The support system 126 can comprise a collapsible frame 136 at each side edge 132 and 134, respectively, wherein each collapsible frame 136 comprises the rear support 128 beneath the rear portion 106 of the seat 102 and the front support 130 beneath the front portion 104 of the seat 102.

Preferably, each collapsible frame 136 is in the shape of a parallelogram. The front of the parallelogram can be attached at or near the pivot location 112. As shown in FIGS. 3D and 3E, the drive 114 can be attached to opposite close corners of the parallelogram such that when the drive 114 pushes upwardly on the opposite close corners, the parallelogram opens up, and when the drive 114 pulls downwardly on the opposite close corners the parallelogram collapses down. Alternatively, as show in FIG. 3F, the drive 114 can be attached to opposite far corners of the parallelogram such that when the drive 114 pushes outwardly on the opposite far corners, the parallelogram collapses down, and when the drive 114 pulls inwardly on the opposite far corners the parallelogram opens up.

The upper two sides of the parallelogram can comprise a longer side and a shorter side, the longer side comprising the front support 130 beneath the front portion 104 of the seat and the shorter side comprising the rear support 128 beneath the rear portion 106 of the seat 102. The lower two sides of the parallelogram comprise a shorter side (also referred to as a shorter member) 138 and a longer side (also referred to as a longer member) 140, the shorter member 138 toward the front of the chair and the longer member 140 toward the back of the chair.

Figure 2:
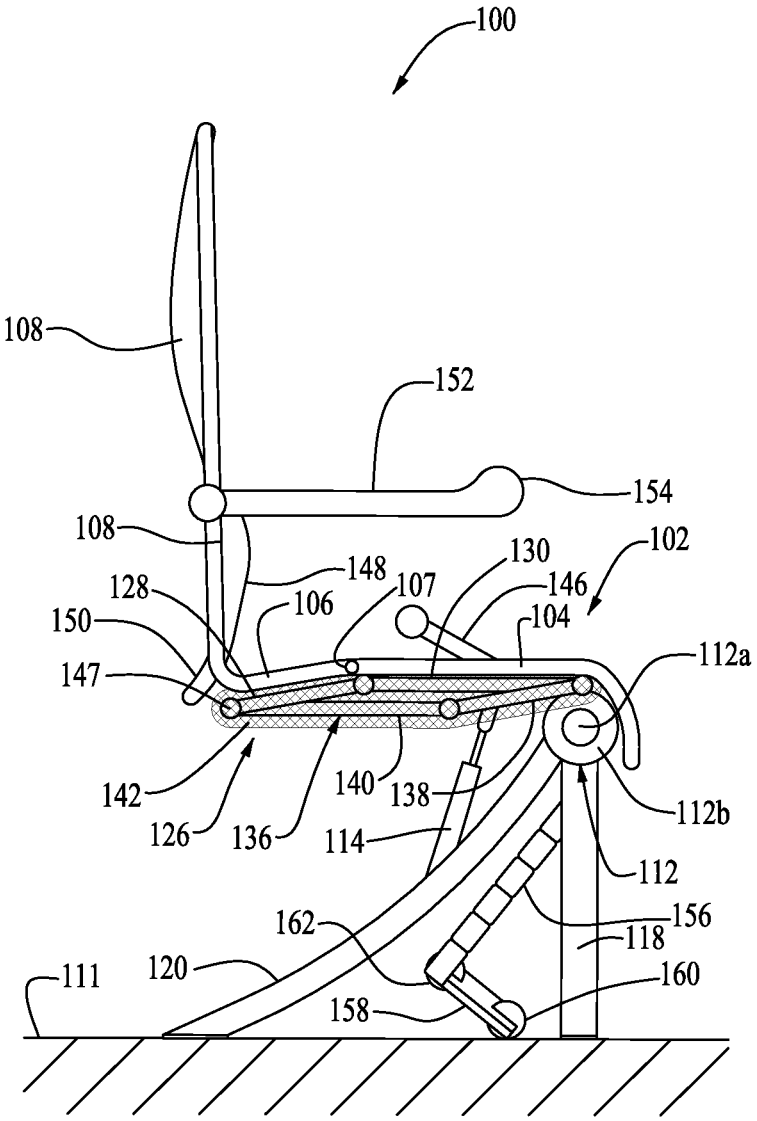
FIG. 2 is a side elevation view of the chair of FIG. 1 in the sitting position.
Figure 4:
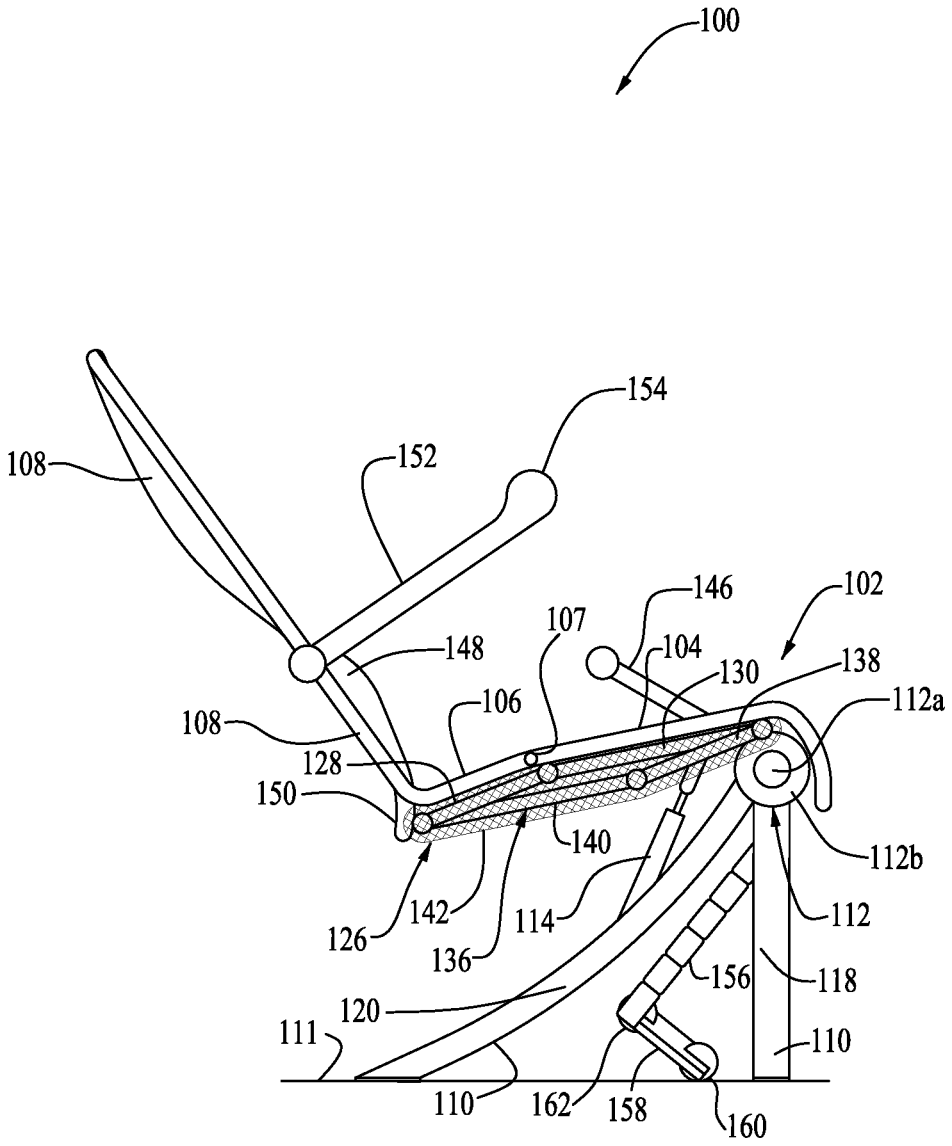

As can be seen from FIGS. 2 and 4, the shorter member 138 rotates at a fixed angle with the rotation of the pivot location 112 like the arm of a clock. It remains at a fixed angle so that the folded-flat parallelogram extends rearwardly substantially horizontally from the pivot location 112 when the drive 114 is not lengthened.

Figure 5:
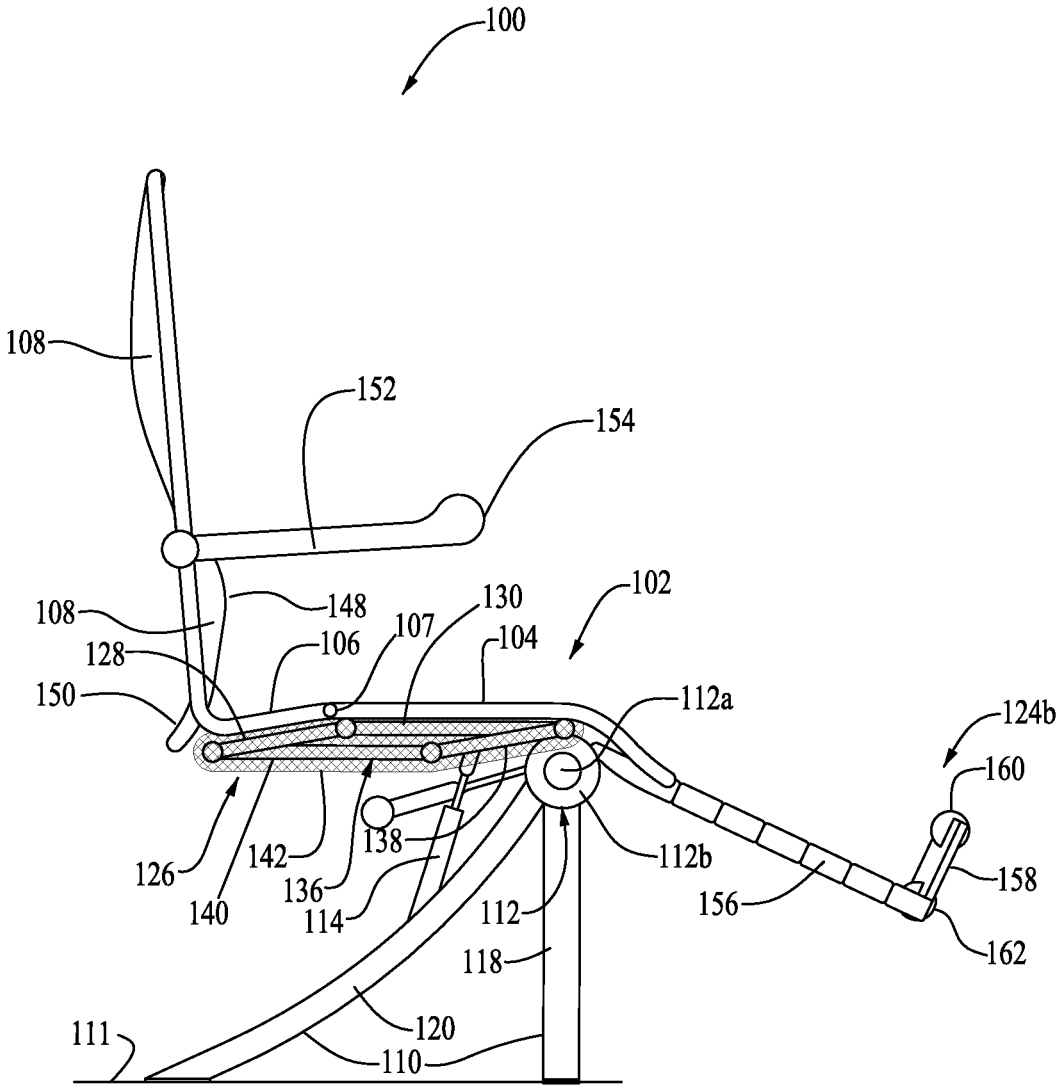
Figure 6:
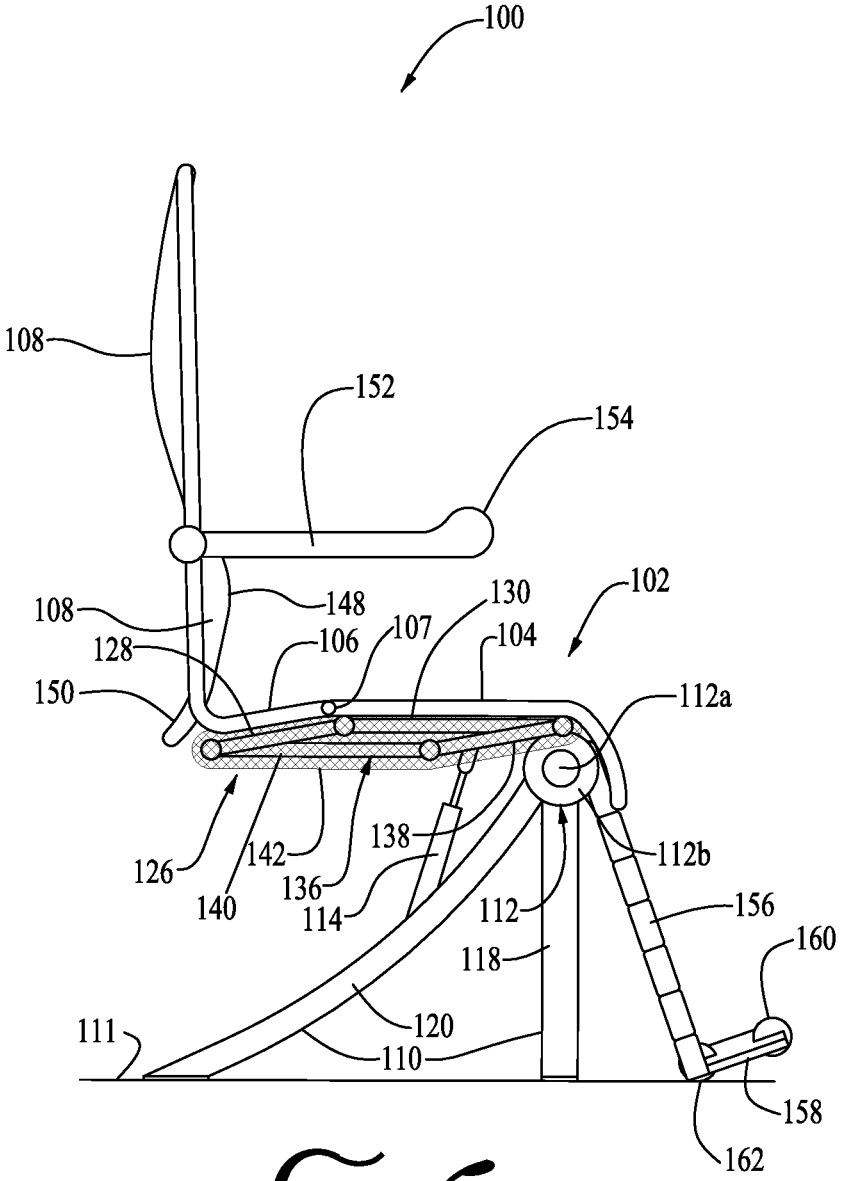
Figure 7:
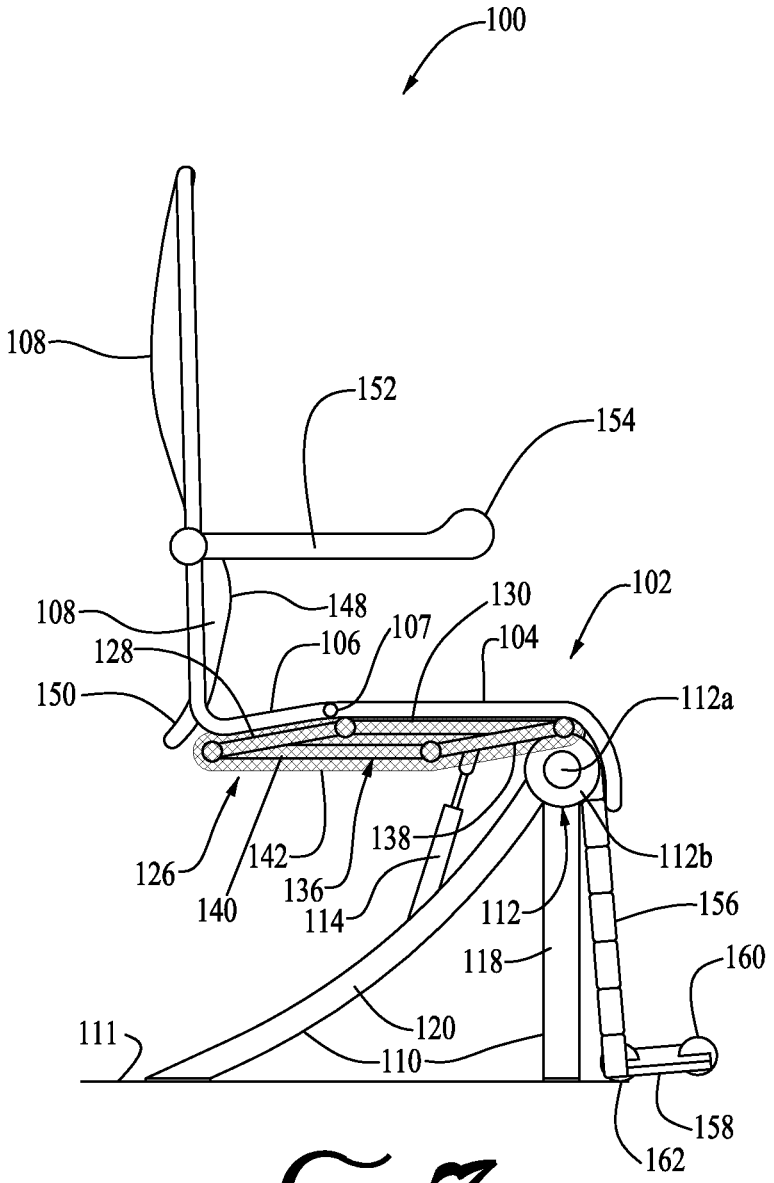

Referring now to FIG. 3, as the drive 114 extends, the front support 130 rotates around the pivot location 112 so that the rear support 128 and front support 130 distance themselves from the longer member 140 and shorter member 138 and the parallelogram opens up. As the parallelogram opens up, the opposite sides of the parallelogram remain parallel, but the angle between adjacent sides changes, while the seat 102 pivots at the pivot mechanism 107. The angle between the rear support 128 and the longer member 140 increases, and the angle between the rear support 128 and front support 130 decreases. The opposite occurs when the drive 114 is contracted to collapse the parallelogram back down. This effect is designed to maintain the rear portion 106 of the seat 102 in a substantially horizontal position while the slope of the front of the seat slopes forwardly above horizontal. When the front support 130 is below substantially horizontal (as shown in FIG. 4), the parallelogram is in a collapsed position and the rear support 128 and the front support 130 remain substantially co-linear. The drive 114 can also function as a stop mechanism to limit the amount the collapsible frame 136 can open. As shown in FIGS. 3 and 5, the rear portion 106 of the seat 102 can incline slightly downwardly toward the back in both the seated position and the standing position.

The parallelogram can be covered by a cover 142 for reasons of safety. In one version, the cover 142 can comprise a bellows that can expand and shrink to fit the movement of the parallelogram.

The drive 114 attaches to the drive support 122 spanning between the front support 130 of the parallelogram such that when the drive 114 extends, the front support 130 attached to the pivot location 112 rotates causing the opposite end to rise and lower with the extension and retraction of the drive 114, respectively. The parallelogram opens when the drive 114 extends because the shorter member 138 of the parallelogram is retained at a fixed angle. The longer member 140 thus rises and lowers with the rotating front support 130. As part of a parallelogram, the rear support 128 travels in a parallel fashion up and down while the pivot mechanism 107 pivots accordingly. An advantage is that the chair 100 thus provides a stable platform for the pelvis and weight of a user's upper body that it supports throughout lifting or lowering the user.

In the version where the drive 114 is a linear drive 115, such as a screw drive, the parallelogram bottoms out at a fixed rotation at which the linear drive 115 is functionally limited. Below this point, all sides of the parallelogram are structured to move and remain together in flattened or collapsed form.

Figure 3A:
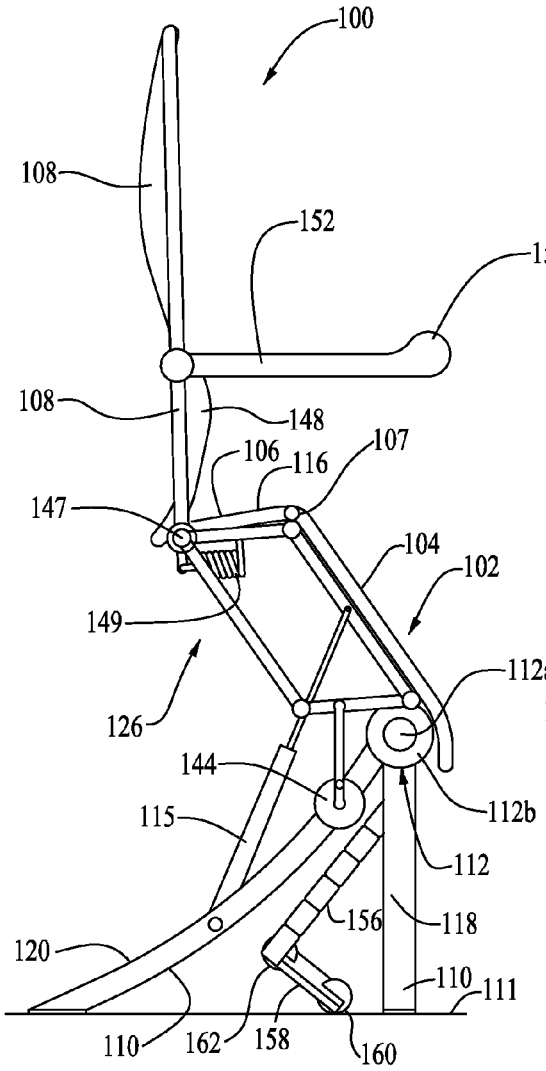
Figure 3B:
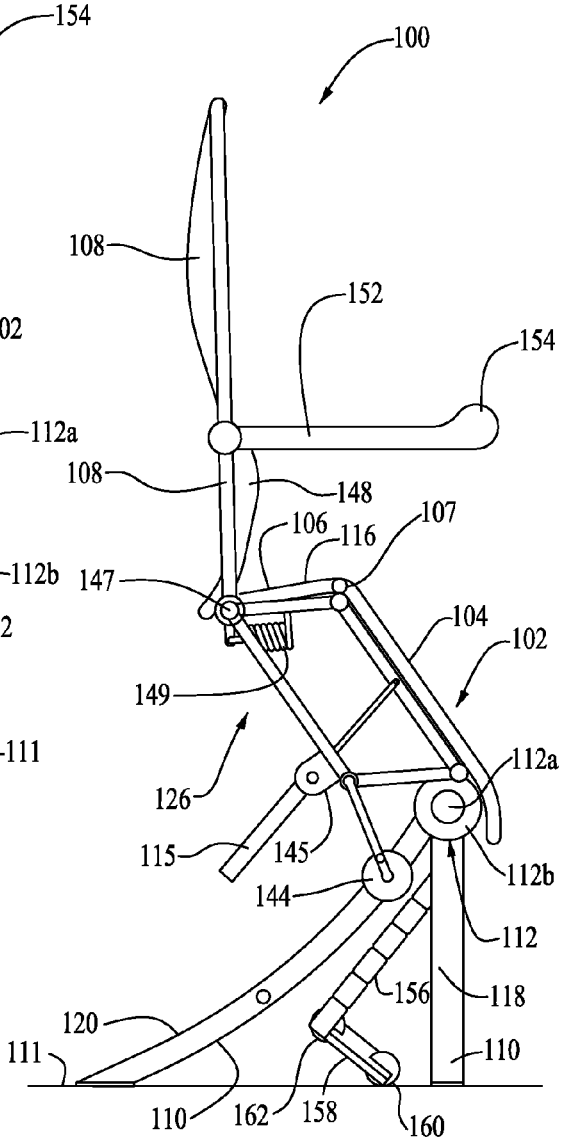
Figure 3C:
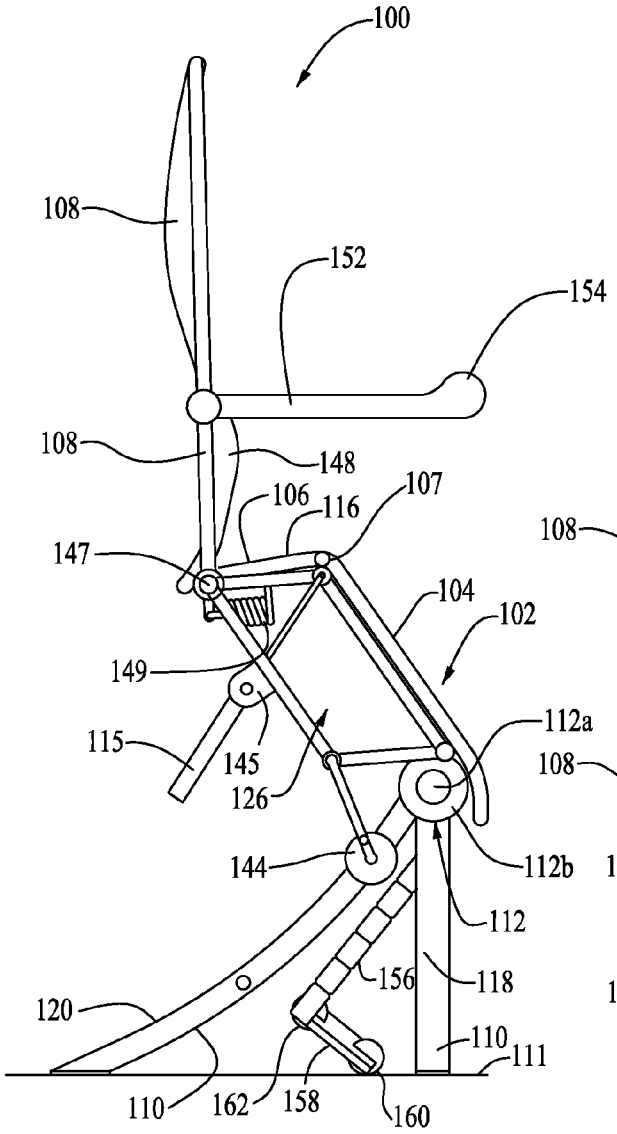
Figure 3D:
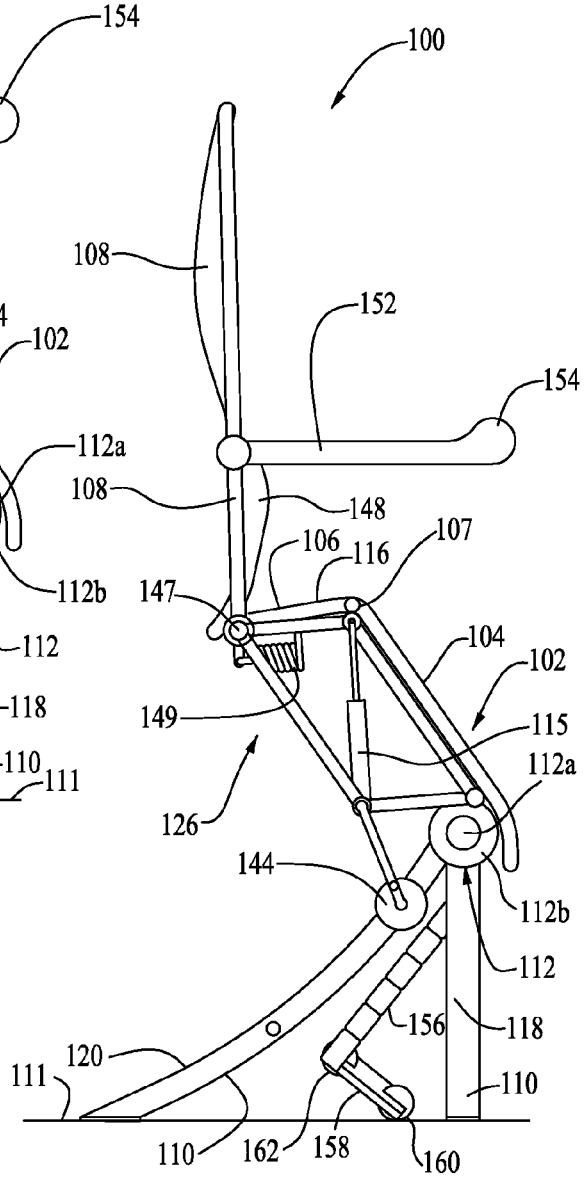
Figure 3E:
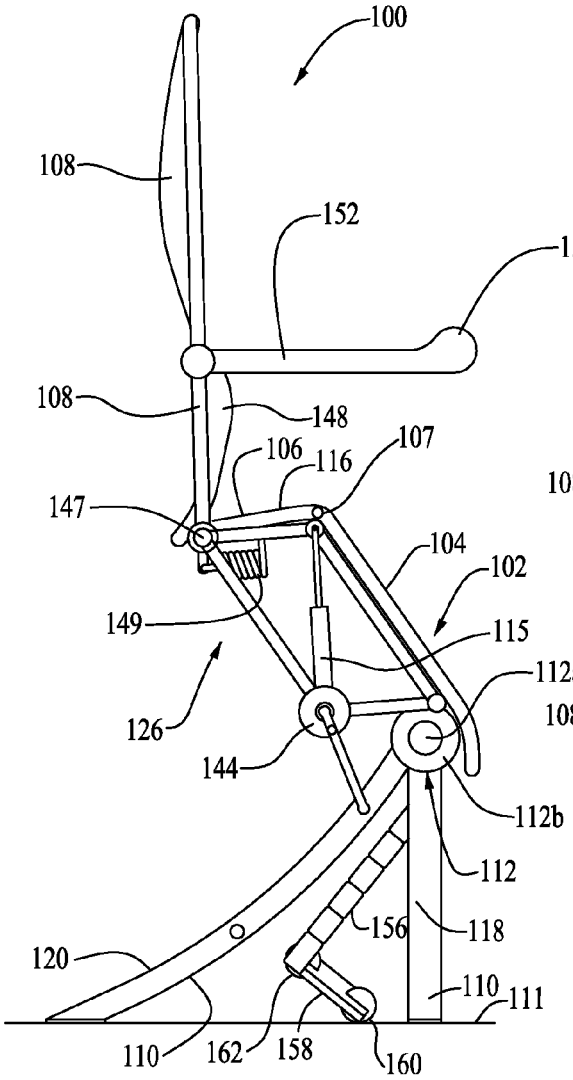
Figure 3F:
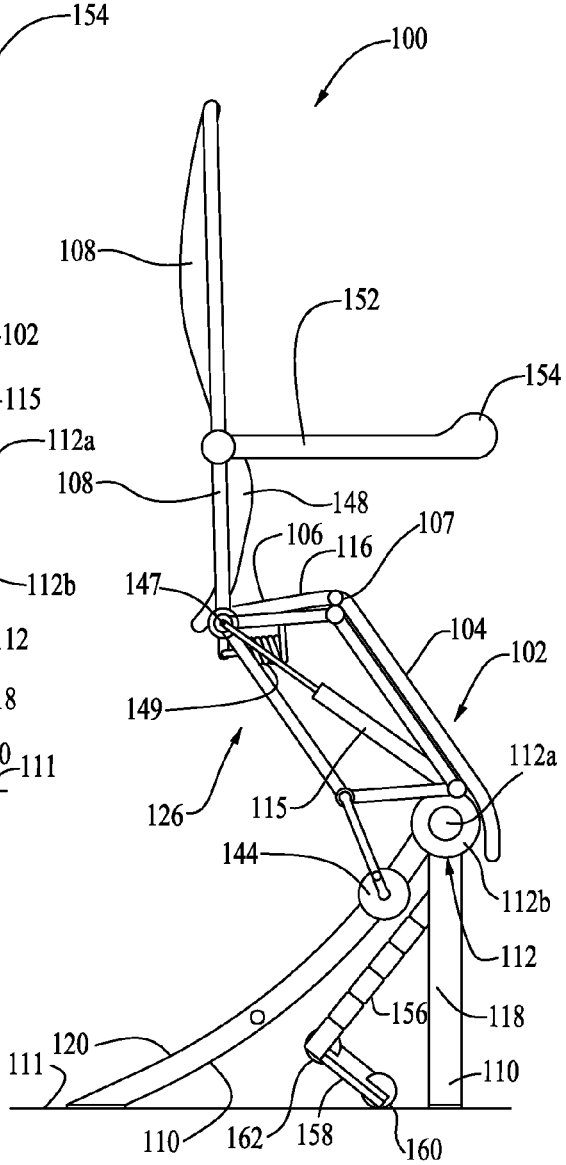

FIGS. 3A-3E show different ways of how the linear drive 115 and a gear motor 144 can be attached to the chair 100. The linear drive 115 and the gear motor 144 can each be affixed separately to the chair 100 (FIG. 3A). The linear drive 115 optionally can be affixed to the gear motor 144 such that the rotation of the gear motor 144 is able to pull and push on the linear drive 115 (FIGS. 3D and 3E). Alternatively, the linear drive 115 can also be attached to the parallelogram with a tab 145 for support (FIGS. 3B and 3C). A strut (not shown) can also be used in place of the gear motor 144 to keep the shorter member 138 of the parallelogram stabilized so the rear support 128 opens up and away from it. In one version the linear drive 115 engages the pivot location 112. The gear motor 144 can also function as a stop mechanism to limit the rotation of the parallelogram about the pivot location 112.

Movements of the gear motor 144 cyclically lower the parallelogram and then return it to a starting level, causing the user of the chair 100 to be rocked pivotably at the pivot location 112 between a recline and a substantially horizontal position. Rotations of the gear motor 144 and extension/contraction of the linear drive 115 are functionally interlinked so that the gear motor 144 fluidly continues the downward rotation of the seat 102. In another version of the invention, the gear motor 144 can comprise a flywheel motor.

In one version, the front portion 104 of the seat 102 extends forwardly of the support system 126 and curves forwardly and down over the pivot location 112. The front portion 104 is flexible and curved to pad the pivot location 112 below it, allows the leg rest 124 to remain substantially co-planar with the seat 102, and provides a waterfall contour to minimize under-thigh pressure that might compromise blood circulation to a user's legs.

The back 108 can be continuous with the seat 102 and cantilevers off the rear portion 106 of the seat at a flex/hinge point 147 so that when the angle of the seat changes, the angle of the back changes with it. The flex/hinge point 147 can be a linkage. For instance, when the seat 102 declines, the back 108 also declines as shown in FIGS. 3A-3E. Springs 149 comprising, but not limited to, coiled, leaf, or gas springs can be attached above and below the flex/hinge point 147 to enhance resistance to rotation. Flexible side frame supports continuous with seat 102 that are thinned or hinged can also be attached at the flex/hinge point 147.

The back 108 can have a lordotic curvature 148 to match a user's spine curvature. This can be accomplished with a cover 142 tensioned from its lower end such that there is no longitudinal tension on the cover 142 when the chair 100 is in the sitting position. The cover 142 is fully tensioned longitudinally when the chair 100 is reclined such that the lordotic curvature 148 is pulled into a progressively flattened shape. The cover 142 can comprise pre-formed contoured flat springs that are affixed along the back 108. An advantage of having the lordotic curvature 148 is that it offers ergonomic support for a user's back in an upright position while offering a preferred flatter support contour for a semi-reclined user.

The back 108 can comprise a flap 150 as shown in FIGS. 2-7 to accommodate as necessary the rearward protrusion of a user's buttocks. This flap 150 is continuous at its top, but is not connected at the bottom allowing the flap 150 to open outwardly to the rear of the chair 100.

The back 108 can be configured to rotate to an upright position that is 7° below vertical, and recline to a reclined position that is 68° past vertical.

The back 108 can comprise vertical side margin flexible frames (not shown) that extend up from side margins of the seat 102. The vertical side margin flexible frames can extend up from the rear portion 106 of the seat 102 to follow the sides of the back 108.

Optionally the chair 100 can have armrests 152 attached adjustably and pivotably at a pivot point 155 to either side of the back 108 so the pivot point 155 can be raised or lowered along the height of the back 108. The entire armrest 152 can be angled radially up to vertical and lowered back to horizontal at the pivot point 155 from a position parallel to the back 108 to substantially horizontal relative to the support surface 111, respectively.

Preferably the armrests 152 have a front swell/knobbed front 154 the contours of which swell upwardly so that arthritic hands can grip them easily. When the armrests 152 are raised parallel to the back 108, the knobs 154 project rearwardly so there is no obstruction when a user slides sideways off the chair 100.

The armrests 152 attach at the rear portion 106 to the back 108 so they move with the movement of the back 108, remaining roughly perpendicular to the back 108 in their lowered position. The armrests 152 can also be affixed to the back 108 so that as the plane of the back angle changes, the plane of the armrests 152 changes accordingly.

Space between the armrests 152 may not offer sufficient clearance for the hips and thighs of some users. As a result, the armrests 152 can be hinged so that they can pivot up out of the way to allow someone with wide hips to enter or exit the chair without interference from the armrests 152. The armrests 152 can be lowered while the widest portions of the body spread out beneath them. End points for their rotation are when they reach horizontal (bottom of rotation) and when they become parallel to the back 108 (top of rotation). These rotation limits are structured into the armrests 152 with stops.

Preferably the leg rest 124 comprises a leg section 156 pivotally attached to the pivot location 112 to pivot from a retracted position 124*a* (shown in FIG. 3) to an extended position 124*b* (shown in FIG. 5), and a foot support 158 mounted to the leg section 156. The foot support 158 is disposed at right angles to the plane of the leg section 156.

The chair 100 can further comprise friction reducers such as a slippery pad made from Teflon (trademark) plastic or a front wheel 160 and a rear wheel 162 for the foot support 158, wherein when the chair 100 is on the support surface 111 and as the leg section 156 pivots from the retracted position 124*a* to the extended position 124*b*, it telescopes longer with at least one wheel rolling on the support surface 111. The leg rest 124 can be spring-loaded to extend, and can be lockable in the extended position 124*b* to suit the user. The amount of telescoping of the leg rest 124 can be fixed by or for the user so that it does not telescope further than is appropriate for the length of the user's legs, but can still retract/telescope inwardly. The leg rest 124 can be constructed telescopically with bellows so that it can lengthen or retract.

A handle 146 can be affixed to the pivot location 112 such that when radially rotated, the handle 146 rotates the leg rest 124. When pushed downwardly towards the support surface 111, the handle 146 rotates the leg rest 124 outwardly and upwardly.

Referring to FIGS. 3 and 4-7, the front wheel 160 and rear wheel 162 are positioned so that as the leg rest 124 is rotated either into the retracted position 124*a* or the extended position 124*b*, one or the other wheel contacts the support surface 111 and causes the leg rest 124 to retract. When the rear wheel 162 contacts the support surface 111 it releases the locked position at which the leg rest 124 was set so that it can retract as the rear wheel 162 rolls along the support surface 111. As it continues to retract, the front wheel 160 then comes in contact with the support surface 111. When the leg rest 124 is extended, the front wheel 160 rolls along the support surface 111 until the rear wheel 162 comes in contact with the support surface 111. As it continues upwardly, the leg rest 124 is spring-loaded such that it self-extends to its maximum length. An optional gear and cable assist (not shown) can make the rotation/retraction easier. An advantage of the leg rest 124 is that a caregiver or assistant can adjust the leg rest 124 for a user's comfort, and that the extended length, unlike conventional leg rests, will be sufficient to preclude a painful consequence known as "foot drop".

Optionally, and especially for the case of an obese or overweight user, the armrest 152 can be attached to the back 108 by a lateral outward extension, so that the left armrest, when viewed front on, can flip (fold over) from a 9 o'clock position to a 3 o'clock position, with the reverse for the opposite-handed armrest. The purpose of this is to still provide elbow support sufficient to prop up the upper body of the user while being able to flip out of the way in order to expand hip clearance for a large user attempting to enter or exit the chair 100.

As described above, the chair 100 can be used to transport users, such as patients as well as lift users from a sitting to standing position and vice versa, with the patient's weight being safely supported throughout the lifting or lowering, and without the user sliding out of the chair 100.

Support Frame

With reference to FIGS. 10-15, a support frame 200 on a surface for supporting, lifting, moving, mobilizing, and ambulating individuals having features of this invention is shown. The frame 200 also serves to organize and make accessible patient-oriented items (shown in FIGS. 14 and 15). The support frame 200 is open from both directions, which for convenience in describing the frame are referred to as a front 202 and a rear 204. The support frame 200 has a base 206 comprising a pair of spaced apart supports 208 having a forward portion 210 and a rearward portion 212, the supports 208 spaced apart a sufficient distance that a user can fit therebetween from the front 202 and the rear 204, a pair of parallel legs 214, also referred to a vertically disposed column legs, extending upwardly from the forward portion 210 of the base 206, each leg 214 having a top 216, and a connector 218 fixedly connecting the top 216 of the legs 214. The connector 218 is at least six feet above the surface so a user can stand under the frame 200. This can be accomplished by having the legs 214 be at least six feet long. The legs 214 are substantially parallel to each other. There is no other permanent connector other than connector 218 between the legs 214, including at the base 206, so a user has access from both the front 202 and rear 204 of the support frame 200. A caregiver can access the user from the front 202 or the rear 204.

The support frame 200 is constructed of structural materials, including but not limited to, plastic, metal, and wood. The legs 214 can be configured such that at least one of the legs 214 comprises a longitudinally extending support of constant outer diameter for at least a portion of its length.

Preferably the top connecting portion 218 is cantilevered from the legs 214 to curve inwardly in order to shift the center of gravity to the rear side 204 of the frame 200.

In one version of the invention, the supports 208 can comprise glides or sled bottoms that slip over floor surfaces but add no appreciable height to the supports 208 to withstand heavy loads. The sled bottoms are tapered in height in order to slide under low-clearance equipment, such as electric drive beds. An advantage of this is so the support frame 200 can be used alongside a patient's bed.

A pair of wheels 220 can be attached to each end of the transition between the legs 214 and the supports 208. The wheels 220 are positioned toward the rear of the support frame 200. The wheels 220 can optionally be omni-directional wheels having a rim consisting of rollers that allow the support frame 200 to move sideways as well as forward and back.

As shown in FIG. 13, the legs 214 can be constructed so that they have a hollow longitudinal central core 222 to accommodate wiring for electrical and communications equipment for at least a portion of their length.

The legs 214 can be configured so that accessory support clamps 224 can attach along most of their height facing in any direction. The support clamps 224 can be adapted to swivel along a central swivel joint. The legs 214 can also be configured with slots 226 or projections 228 from which medical monitoring devices, IV and drainage bags, etc. can be hung.

The sled base 206 is configured to make a low-voltage connection with a charging device or induction coil located on either or both of a chair and a bed in association with which the support frame 200 is used. A rechargeable battery pack attached in the same manner as medical devices stores power when the support frame 200 is associated with a charger-equipped bed or chair and provides power when the support frame 200 is otherwise free-standing.

Power outlets 230 and communication outlets 232 are recessed between swelled portions of the legs 214 such that electrical and communication devices can be powered from the support frame 200.

As shown in FIG. 11, the legs 214 are configured so that a tray 234 can slide up and down manually and be supported rigidly and rotate 90 degrees in a horizontal plane. In one version the tray 234 can automatically rise and lower with the motion of a chair. The tray 234 can also assume a shin stop position or stow alongside the support frame 200. The tray 234 can be made of a transparent material so the patient can see through it. The tray 234 can also be adapted so a portion of it can slide out to increase its usable surface area.

The connector 218 is configured to support a lift motor and extension cable which can be used to support, lift, or lower a patient. The patient can be wearing an engagement garment, such as the lifting garment discussed below, meant to be worn continuously by the patient to facilitate lifting or lowering of the patient by the frame 200.

The connector 218 can comprise a mount 236 that can be configured to accommodate twin low-voltage lights 238 to provide extra illumination.

Lifting Garment

With regard to FIG. 16, a lifting garment 300 for lifting, moving, and mobilizing individuals having features of this invention is shown. The garment 300 comprises a body portion 302 with leg portions 304 extending therefrom, and attachment hardware 306, such as D-rings, secured to the body portion 302 for attaching a lifting mechanism 308 to the garment 300. The attachment hardware 306 can also be straps, a belt, fabric loops, or the like. At least a portion of the body portion 302 is formed of a woven material 310 having a bias and is oriented so that lifting a person wearing the garment 300 in a lifting direction causes tightening of the garment 300 on the person in a direction angled relative to the first direction. The attachment hardware 306 of the lifting garment 300 can be attached to the support frame 200.

The garment 300 is constructed to work like a "Chinese finger puzzle". It's made of a lightweight weave or knit sewn so that as it is pulled in one direction (that is, lifted), it shrinks in the other direction, tightening comfortably around the patient. The garment 300 is made from strong lightweight material which narrows/tightens around a patient as it is pulled in one direction, as in lifting or supporting the weight of a patient. An advantage of the garment 300 is that engagement of a patient by a lifting bar is rapid and effortless so that the patient can be lifted and transported easily and efficiently.

It can be worn full-time and has shoulder-top rings sewn into it to facilitate easy and rapid engagement.

The engagement garment 300 engages a patient's upper legs and can have cut-outs 312 in crotch front to back for personal hygiene.

The engagement garment 300 is open, breathable, and washable (with modesty skirting). Preferably, the engagement garment 300 is worn continuously and replaces or supplements a patient gown. Preferably, the engagement garment 300 fits many sizes of patients by virtue of its elastomeric and flexible construction.

In one version, the garment 300 has electro-conductive fibers sufficient to allow for the integration of patient monitoring means for as many vital signs as possible, including body temperature, pulse or heart rate, blood pressure, respiratory rate, and emotional distress.

The garment 300 can also be an expandable platform system in which a variety of capabilities and accoutrements can be integrated and which is intended to become the hub of a telemetry link between the patient and his/her clinical partners. It can pick up and/or relay, in real time, vital signs and other health status indices to the other expandable system, such as the support frame 200, and beyond, for monitoring and/or analysis. Vital signs monitoring include temperature, blood pressure, blood oxygenation, and other diagnostic functionality. Capabilities include warming, sound & vibration, etc.

A method of using a support frame in combination with a reclinable chair comprises the steps of selecting a support frame with a tray that slides up and down, selecting a reclinable chair, and raising the chair while simultaneously raising the tray and lowering the chair while simultaneously lowering the tray is disclosed.

Any element in a claim that does not explicitly state "means for" performing a specified function, or "step for" performing a specific function, is not to be interpreted as a "means" or "step" clause as specified in 35 U.S.C. §112, ¶6. In particular, the use of "attachment means" in the claims herein includes D-rings attached to the garment, straps, or buckles.

Although the present invention has been described in considerable detail with reference to certain preferred versions thereof, other versions are possible. For example, the friction reducers of the chair can comprise reduced friction padding, and the lifting garment can be adapted to allow for use in water. Also, the lifting garment need not need leg sections, but only need to encompass a user's torso. Therefore, the spirit and scope of the appended claims should not be limited to the description of the preferred versions contained herein.

What is claimed is:

1. A chair comprising:

a) a seat having a front portion and a rear portion and opposed side edges, the chair having a seated position with the seat being substantially horizontal;

b) a support system for the seat, the support system comprising a collapsible frame for each side edge, each frame being in the shape of a parallelogram, each parallelogram being formed by one or more than one members;

c) a pivot mechanism between the front and rear portions so they can pivot relative to each other;

d) a back extending upwardly from the rear portion of the seat;

e) legs for supporting the seat, wherein the front portion of the seat pivots upwardly from a pivot location at the front portion of the seat for lifting a user from the seated position toward a standing position, wherein the rear portion of the seat inclines slightly downwardly toward the back both in the seated position and in the standing position, and wherein the rear portion pivots relative to the front portion so that the rear portion of the seat remains generally horizontal with an incline slightly downwardly toward the back as the front portion of the seat pivots upwardly toward the standing position; and f) a drive for pivoting the front portion of the seat upwardly toward the standing position.

2. The chair of claim 1 wherein one of the members forming the parallelogram remains at a fixed angle relative to the pivot location as the front portion of the seat pivots upwardly toward the standing position.

3. The chair of claim 1 wherein the chair comprises arm rests pivotally connected to the back so that the arm rests remain substantially horizontal in the seated position and in the standing position.

4. The chair of claim 1 wherein the drive comprises a drive in combination with a gear motor to facilitate both lifting and rocking of a user on the chair.

5. The chair of claim 1 wherein the entire seat can rock rearwardly and downwardly from the pivot location.

6. A method of using the chair of claim 1 comprising the steps of:

a) selecting a support frame, the support frame having a front side and a rear side, the frame suitable for placement on a surface, the frame comprising:

i) a base comprising a pair of spaced apart supports, the supports spaced apart a sufficient distance that a user can fit between the supports from the front side and the rear side; and ii) a pair of legs extending upwardly from the base;

b) providing a tray coupled to the pair of legs, the tray being configured to slide up and down on the legs; and c) raising the chair while simultaneously raising the tray and lowering the chair while simultaneously lowering the tray.

7. The chair of claim 1 wherein the amount the collapsible frame can open is limited by a stop mechanism.

8. The chair of claim 1 wherein the seat can rock pivotably at the pivot location between a recline position and a substantially horizontal position.

9. The chair of claim 1 wherein each frame comprises a rear support beneath the rear portion of the seat for maintaining the rear portion of the seat substantially horizontal as the seat pivots upwardly toward the standing position.

10. The chair of claim 9 wherein each frame comprises a front support beneath the front portion of the seat pivotally connected to the rear support for supporting the front portion of the seat.

11. The chair of claim 1 comprising a leg rest comprising a leg section pivotally attached to the front of the seat to pivot from a retracted position to an extended position, a foot support section mounted to the leg section, and friction reducers for reducing friction between the foot support section and a support surface for the chair.

12. The chair of claim 11 wherein the friction reducers comprise a front wheel and a rear wheel for the foot support section.

13. The chair of claim 11 wherein as the leg section pivots from the retracted position to the extended position, it telescopes longer with at least one friction reducer on the support surface.

14. The chair of claim 11 wherein the leg rest is spring-loaded to extend to an extended position and is lockable in the extended position.

15. A chair comprising:

a) a seat having a front portion and a rear portion and opposed side edges, the chair having a seated position with the seat being substantially horizontal;

b) a support system for the seat, the support system comprising a collapsible frame for each side edge, each frame being in the shape of a parallelogram, each parallelogram being formed by one or more than one members;

c) a pivot mechanism between the front and rear portions so they can pivot relative to each other;

d) a back extending upwardly from the rear portion of the seat;

wherein the back has a lordotic curvature in an upright position, wherein the lordotic curvature automatically partially flattens out as the chair reclines;

e) legs for supporting the seat, wherein the front portion of the seat pivots upwardly from a pivot location at the front portion of the seat for lifting a user from the seated position toward a standing position, and wherein the rear portion pivots relative to the front portion so that the rear portion of the seat remains substantially horizontal as the front portion of the seat pivots upwardly toward the standing position; and f) a drive for pivoting the front portion of the seat upwardly toward the standing position.

16. The chair of claim 15, wherein the rear portion of the seat remains substantially horizontal with an incline slightly downwardly toward the back both in the seated position and in the standing position.

* * * * *